US009064642B2

(12) United States Patent
Welch et al.

(10) Patent No.: US 9,064,642 B2
(45) Date of Patent: Jun. 23, 2015

(54) RATTLE-FREE KEYSWITCH MECHANISM

(71) Applicant: Apple Inc., Cupertino, CA (US)

(72) Inventors: Harold J. Welch, San Jose, CA (US); Craig C. Leong, San Jose, CA (US); James J. Niu, San Jose, CA (US); John M. Brock, San Francisco, CA (US); Keith J. Hendren, San Francisco, CA (US); Robert L. Coish, Mountain View, CA (US); Robert S. Murphy, Sunnyvale, CA (US); William P. Yarak, III, San Francisco, CA (US)

(73) Assignee: APPLE INC., Cupertino, CA (US)

( * ) Notice: Subject to any disclaimer, the term of this patent is extended or adjusted under 35 U.S.C. 154(b) by 145 days.

(21) Appl. No.: 13/792,128

(22) Filed: Mar. 10, 2013

(65) Prior Publication Data

US 2014/0251772 A1 Sep. 11, 2014

(51) Int. Cl.
*H01H 13/14* (2006.01)
*H01H 3/12* (2006.01)

(52) U.S. Cl.
CPC ..... *H01H 3/125* (2013.01); *H01H 2221/062* (2013.01)

(58) Field of Classification Search
CPC ..... H01H 3/125; H01H 13/14
USPC ..... 200/5 A, 344
See application file for complete search history.

(56) References Cited

U.S. PATENT DOCUMENTS

| | | | |
|---|---|---|---|
| 4,319,099 | A | 3/1982 | Asher |
| 5,136,131 | A | 8/1992 | Komaki |
| 5,457,297 | A | 10/1995 | Chen |
| 5,512,719 | A | 4/1996 | Okada et al. |
| 5,625,532 | A | 4/1997 | Sellers |
| 5,828,015 | A | 10/1998 | Coulon |
| 5,847,337 | A | 12/1998 | Chen |
| 5,878,872 | A | 3/1999 | Tsai |
| 5,986,227 | A | 11/1999 | Hon |
| 6,020,565 | A | 2/2000 | Pan |
| 6,257,782 | B1 | 7/2001 | Maruyama et al. |
| 6,542,355 | B1 | 4/2003 | Huang |
| 6,759,614 | B2 | 7/2004 | Yoneyama |
| 6,850,227 | B2 | 2/2005 | Takahashi et al. |
| 6,977,352 | B2 | 12/2005 | Oosawa |
| 6,987,466 | B1 | 1/2006 | Welch et al. |
| 7,129,930 | B1 | 10/2006 | Cathey et al. |
| 7,301,113 | B2 | 11/2007 | Nishimura et al. |
| 7,510,342 | B2 | 3/2009 | Lane et al. |
| 7,842,895 | B2 | 11/2010 | Lee |
| 7,847,204 | B2 | 12/2010 | Tsai |
| 7,866,866 | B2 | 1/2011 | Wahlstrom |

(Continued)

FOREIGN PATENT DOCUMENTS

| | | |
|---|---|---|
| CN | 2155620 | 2/1994 |
| CN | 2394309 | 8/2000 |

(Continued)

*Primary Examiner* — Renee Luebke
*Assistant Examiner* — Ahmed Saeed
(74) *Attorney, Agent, or Firm* — Brownstein Hyatt Farber Schreck LLP

(57) ABSTRACT

A keyswitch mechanism having reduced key rattle and a keyboard having reduced key rattle. A rattle suppression mechanism may be formed on a portion of the scissor mechanism or on a portion of the keycap. The rattle suppression mechanism is configured to maintain force on the portion of the scissor mechanism abutting the keycap.

20 Claims, 13 Drawing Sheets

(56) References Cited

U.S. PATENT DOCUMENTS

| | | | | |
|---|---|---|---|---|
| 8,080,744 | B2 * | 12/2011 | Yeh et al. | 200/5 A |
| 8,109,650 | B2 | 2/2012 | Chang et al. | |
| 8,134,094 | B2 | 3/2012 | Tsao et al. | |
| 8,232,958 | B2 | 7/2012 | Tolbert | |
| 8,253,052 | B2 | 8/2012 | Chen | |
| 8,263,887 | B2 | 9/2012 | Chen et al. | |
| 8,319,298 | B2 | 11/2012 | Hsu | |
| 8,330,725 | B2 | 12/2012 | Mahowald et al. | |
| 8,451,146 | B2 | 5/2013 | Mahowald et al. | |
| 8,500,348 | B2 | 8/2013 | Dumont et al. | |
| 8,569,639 | B2 | 10/2013 | Strittmatter | |
| 8,592,702 | B2 | 11/2013 | Tsai | |
| 8,629,362 | B1 * | 1/2014 | Knighton et al. | 200/344 |
| 8,651,720 | B2 | 2/2014 | Sherman et al. | |
| 8,854,312 | B2 | 10/2014 | Meierling | |
| 2001/0037936 | A1 * | 11/2001 | Hsu et al. | 200/517 |
| 2002/0093436 | A1 | 7/2002 | Lien | |
| 2006/0243987 | A1 | 11/2006 | Lai | |
| 2007/0200823 | A1 | 8/2007 | Bytheway et al. | |
| 2010/0213044 | A1 | 8/2010 | Strittmatter et al. | |
| 2010/0253630 | A1 | 10/2010 | Homma et al. | |
| 2011/0032127 | A1 | 2/2011 | Roush | |
| 2011/0203912 | A1 | 8/2011 | Niu et al. | |
| 2012/0098751 | A1 | 4/2012 | Liu | |
| 2012/0168294 | A1 | 7/2012 | Pegg | |
| 2012/0193202 | A1 | 8/2012 | Chen | |
| 2012/0286701 | A1 | 11/2012 | Yang et al. | |
| 2013/0162450 | A1 | 6/2013 | Leong et al. | |
| 2014/0116865 | A1 | 5/2014 | Leong et al. | |
| 2014/0118264 | A1 | 5/2014 | Leong et al. | |
| 2014/0346025 | A1 | 11/2014 | Hendren et al. | |
| 2015/0016038 | A1 | 1/2015 | Niu et al. | |

FOREIGN PATENT DOCUMENTS

| | | |
|---|---|---|
| CN | 101572195 | 11/2009 |
| CN | 201956238 | 8/2011 |
| CN | 202040690 | 11/2011 |
| CN | 203520312 | 4/2014 |
| DE | 29704100 | 4/1997 |
| EP | 0441993 | 8/1991 |
| JP | 2000057871 | 2/2000 |
| WO | WO2005/057320 | 6/2005 |

* cited by examiner

RATTLE-FREE KEYSWITCH MECHANISM

TECHNICAL FIELD

The present invention relates to keyboards generally and keyboard keyswitch mechanisms particularly.

BACKGROUND

Electronic devices are ubiquitous in society and can be found in everything from household appliances to computers. Many electronic devices include a keyboard or keypad. These keyboards or keypads include keyswitches that may rattle undesirably at various times, such as during typing, when brushing across them, when carrying the electronic device, or when the device is subjected to any form of vibration. In any of these situations this rattling may detract from the user's perception of quality or enjoyment of the device. Additionally, key rattle may lead to wear within the keyswitch mechanism, becoming worse over time and potentially leading to further issues with the functioning of the keyboard. Thus, key rattling may generally be assumed to be a negative trait for electronic devices.

One source of this key rattling originates from various pieces of certain keyswitch mechanisms knocking against one another during operation or other activities, such as those described above. In many scissor-type keyswitch mechanisms, such knocking typically results from clearances between mating features of the mechanism that are included to avoid any binding of components of the switch mechanism when it is operated.

Sample embodiments described herein utilize various approaches to reduce key rattling within electronic devices, while maintaining non-binding operation of example keyswitch mechanisms.

SUMMARY

One sample embodiment, as described herein, is a keyswitch mechanism having reduced key rattle. The keyswitch mechanism includes: a base having a surface; a scissor mechanism slidably coupled to the base; a keycap abutting the scissor mechanism; and a rattle suppression mechanism formed on a portion of the scissor mechanism. The rattle suppression mechanism is configured to maintain force on the portion of the scissor mechanism abutting the keycap.

Another example embodiment of the present invention is a keyswitch mechanism having reduced key rattle. The keyswitch mechanism includes: a base having a surface; a scissor mechanism slidably coupled to the base; and a keycap abutting the scissor mechanism. The keycap includes a rattle suppression mechanism that is configured to maintain force on a portion of the scissor mechanism abutting the keycap.

A further example embodiment of the present invention is a keyboard having reduced key rattle. The keyboard includes: a backplate; a wiring layer coupled to the backplate; a housing coupled to the backplate and configured to hold a plurality of keys; and the plurality of keys. Each key includes: a key base mechanically coupled to at least one of the backplate or the housing; a dome switch mechanically coupled to the key base and electrically coupled to the wiring layer; a scissor mechanism slidably coupled to the key base; a keycap mechanically coupled to the dome switch and abutting the scissor mechanism; and a rattle suppression mechanism. The rattle suppression mechanism is formed on a portion of the scissor mechanism or on a portion of the keycap. The rattle suppression mechanism is configured to maintain force on the portion of the scissor mechanism abutting the keycap.

While multiple embodiments are disclosed, including variations thereof, still other embodiments of the present disclosure will become apparent to those skilled in the art from the following detailed description, which shows and describes illustrative embodiments of the disclosure. As will be realized, the disclosure is capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the present disclosure, it is believed that the embodiments are best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures:

DETAILED DESCRIPTION

Figure 1:
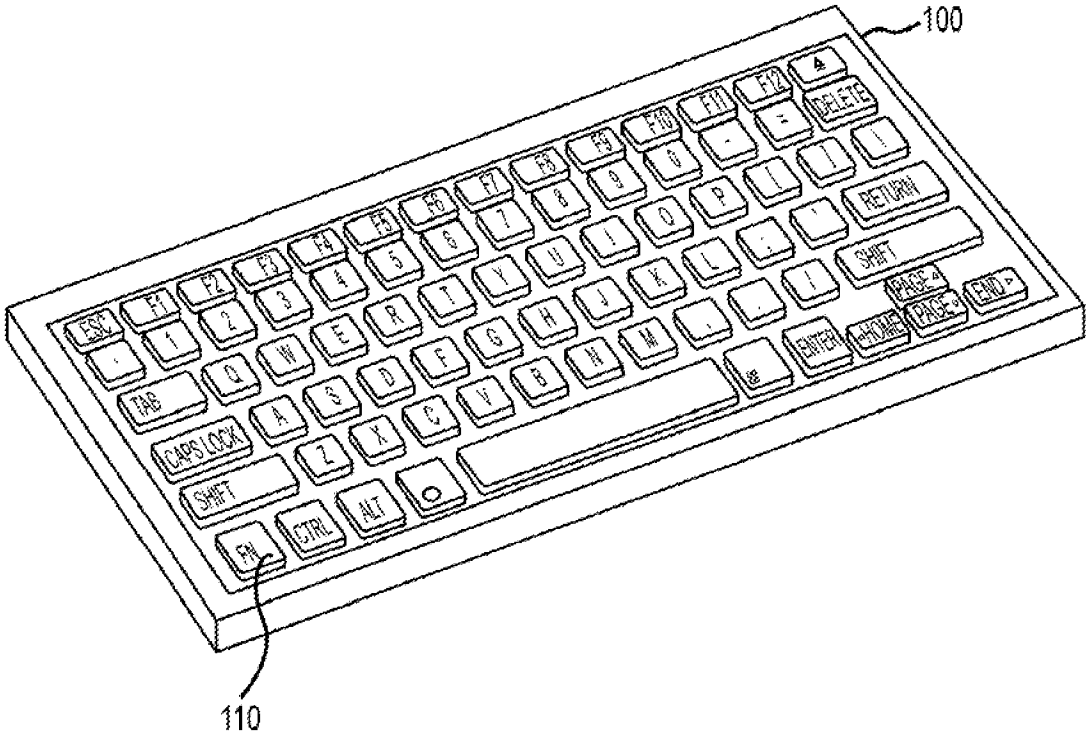
FIG. 1 is a perspective drawing of an example keyboard.

FIG. 1 generally depicts a keyboard 100. Although the keyboard is shown as stand-alone, it should be appreciated that the discussion herein applies generally to all keyboards, whether stand-alone or integrated into another product such as a laptop computer. Likewise, certain principles discussed herein may be applied to other input and/or output devices that include keys, such as mice, trackballs, keypads, and the like. The keyboard may be considered an "input device" and each key an "input mechanism."

Figure 2:
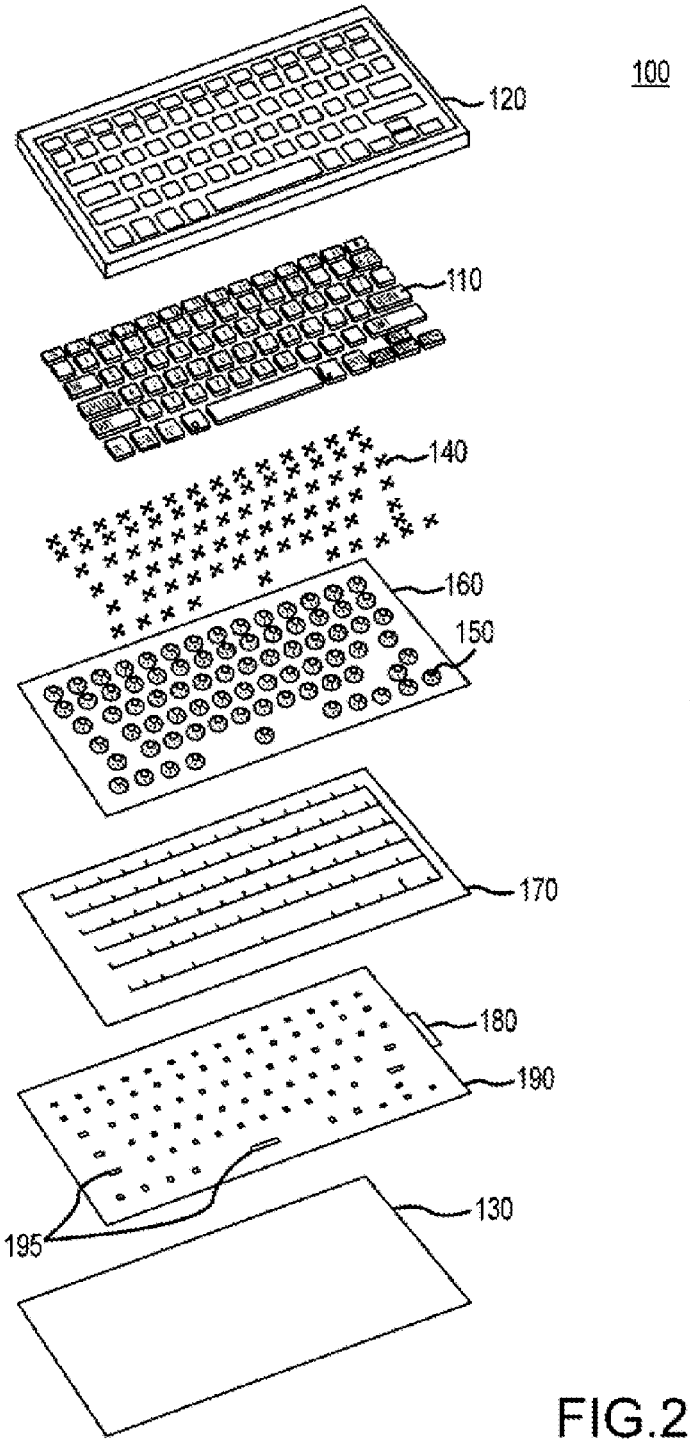
FIG. 2 is an exploded perspective drawing of the keyboard of FIG. 1.

The keyboard 100 of FIG. 1 includes multiple keys with keycaps 110. FIG. 2 generally shows an exploded view of the keyboard 100 of FIG. 1. As shown, the keyboard typically includes multiple layers. The individual keycaps 110 are at least partially contained within a housing or faceplate 120 that surrounds the keyboard. A backplate 130 may define a bottom portion of the housing 120. Each key is attached to a scissor mechanism 140 that biases the key upward. As the keycap 110 of a key is pressed, the scissor collapses, permitting the key to travel downward. This motion also collapses a dome switch 150 located beneath the keyboard. The dome switches 150 all may be formed on a single dome switch layer 160. A metal patch is formed at the top of the dome. When this patch impacts a contact on the wiring layer 170 beneath the dome. The wiring layer is connected to a microprocessor, which detects the closed circuit, registers it as a key press and generates an output or otherwise processes the closed circuit accordingly. A support layer (not shown) may be located adjacent the wiring layer to provide structural stiffness to the wiring.

In another embodiment, the downward motion of the key 110 pushes a plunger or other protrusion through a hole at the top of a dome 150. The plunger, which generally has an end made of metal or that is otherwise electrically conductive, touches a contact on the bottom of the dome switch when the keyboard is sufficiently depressed. This contact creates a closed circuit with the results discussed above.

As also shown in FIG. 2, many keyboards 100 may include an illumination system that backlights one or more individual keys. To be backlit, a key generally has its legend, symbol or the like etched through the paint or other opaque surface of the keycap 110. Oftentimes, this etching is in the shape of the letter, number or symbol corresponding to the key's input. One or more light-emitting diodes (LEDs) 180 may be positioned around the exterior of a light guide. (In some cases, one or more LEDs may also be placed in apertures within the light guide.) Light is emitted by the LEDs into the light guide 190, which is formed from a transparent or translucent material that permits the light to propagate therethrough. A pattern of microlenses 195 may be formed on the light guide 190. As light emitted from the LEDs 180 enters the microlenses 195, the light is redirected to be emitted upward and out of the microlenses.

As noted above, one issue with keyboards and other key-based input devices used in consumer electronics is key rattle. A common source of this key rattle is space that is often left for clearance of various mechanical components to prevent binding in the keyswitch mechanism during operation of the key. This space may allow the components to move in undesired directions and/or magnitudes, producing key rattle.

Embodiments described herein may include a number of example embodiments designed to reduce the amount of key rattle associated with key-based input devices. Some of these example embodiments include features to apply pressure to certain mechanical components within these keyswitch mechanisms to reduce these components' freedom to move in undesired directions and/or magnitudes, thus reducing, or potentially eliminating, key rattle associated with these motions. Additionally, some example embodiments include features to dampen the motion of certain mechanical components within these keyswitch mechanisms, which may also reduce, or potentially eliminate, key rattle associated with these components. One skilled in the art will understand that, although illustrated separately for clarity, many of these example embodiments may be used in conjunction to further improve the stability of the keyswitch mechanism and reduce key rattle.

Figure 3A:
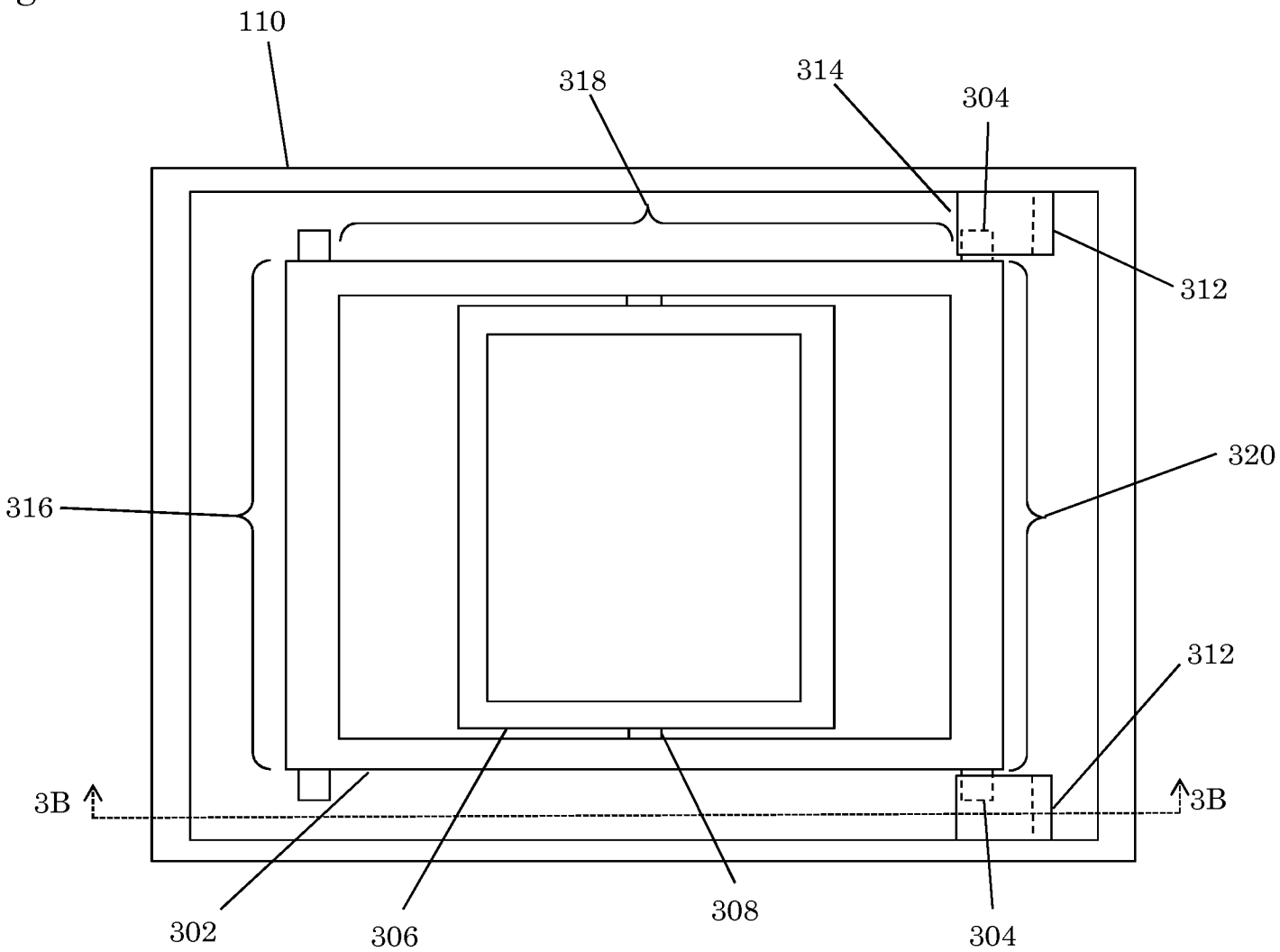
FIG. 3A is bottom plan drawing of an example keyswitch mechanism.
Figure 3B:
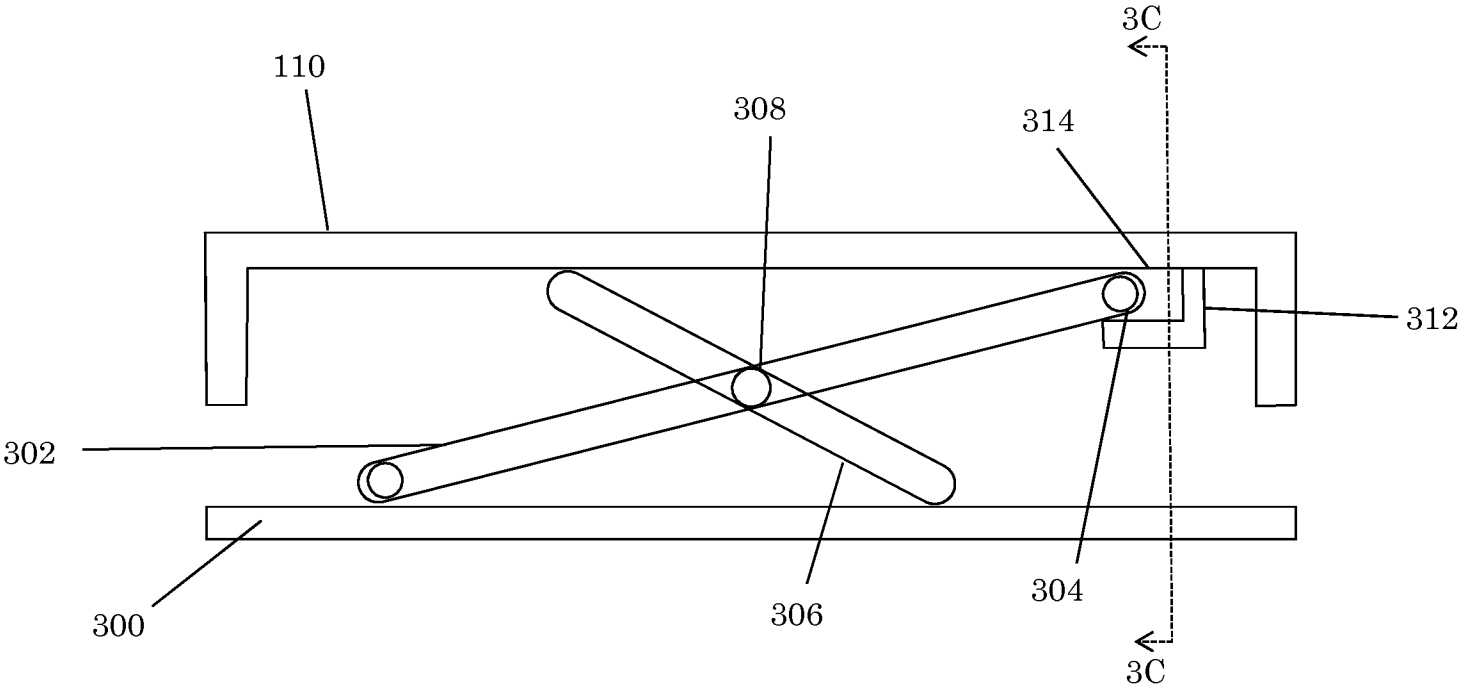
FIG. 3B is side cut-away drawing of the example keyswitch mechanism of FIG. 3A along line 3B-3B.
Figure 3C:
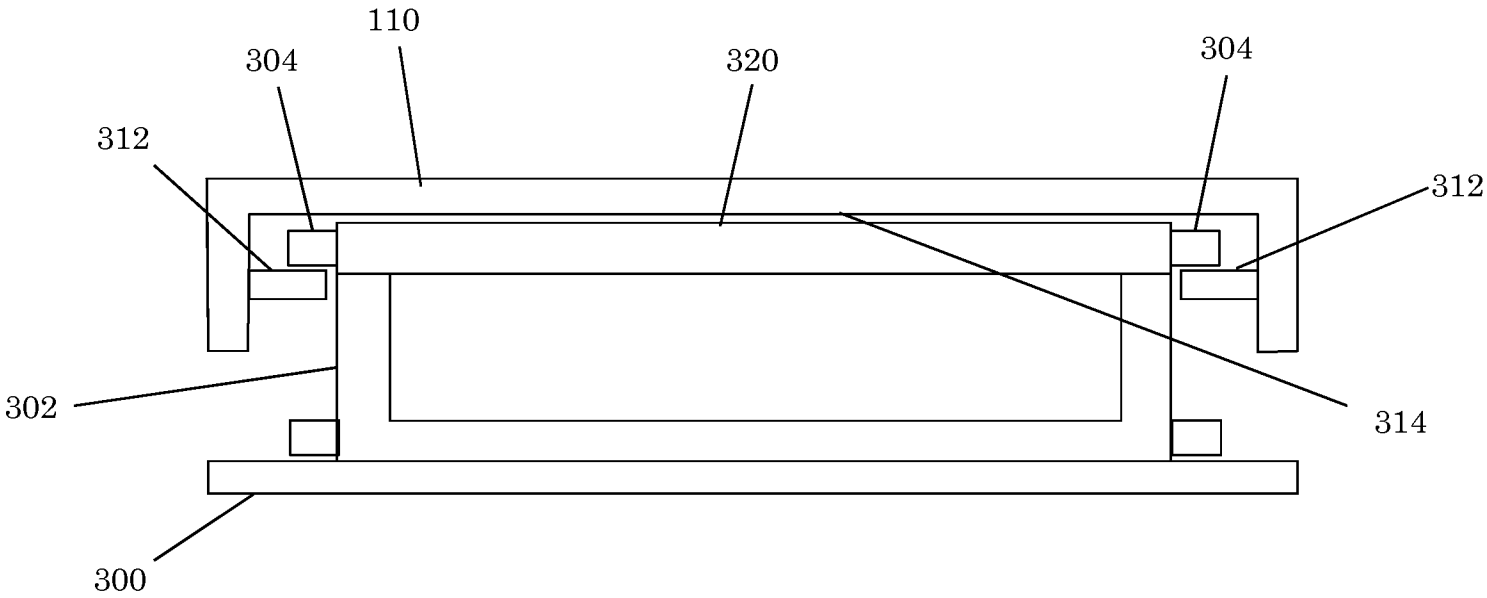
FIG. 3C is front cut-away drawing of the example keyswitch mechanism of FIGS. 3A and 3B along line 3C-3C.

FIGS. 3A-C provide three orthogonal views to illustrate, in more detail than FIG. 2, an example basic scissor-type keyswitch mechanism that may be used in keyboards and other key-based input devices. Various sample embodiments are illustrated in FIGS. 4A-C, 5A, 5B, 6A, 6B, and 7. The embodiments illustrated in detail by these figures include various example features that may be used in conjunction with the underlying scissor-type keyswitch mechanism of FIGS. 3A-C. This example keyswitch mechanism includes: base 300; a scissor mechanism; and keycap 110. It is noted that FIG. 3A, which is a bottom plan drawing, does not include base 300; and FIG. 3C, which is a front cut-away drawing, does not include the second scissor arm or pivots of the example scissor mechanism. One skilled in the art may understand that these omissions do not indicate a lack of these elements, but rather these omissions serve to reduce clutter in the figures and simplify viewing the other components of the example keyswitch mechanism.

The example scissor mechanism of FIGS. 3A-C includes: first scissor arm 302; second scissor arm 306; pivots 308 to couple first scissor arm 302 and second scissor arm 306 such that these scissor arms may rotate about this pivots; and scissor slide pins 304 to slidably couple first scissor arm 302 to keycap 110. Pivots 308 may be bearing or they may be formed out of flexible material coupling the scissor arms. Such flexible pivots 308 may provide the bias to extend the key when keycap 110 is depressed then released.

Second scissor arm 306 is shown in FIG. 3B as having ends in contact with, but not fixedly coupled to, base 300 and keycap 110, while first scissor arm 306 is rotatably coupled to base 300. Thus, during operation of the example key, the ends of second scissor arm 306 may freely slide over the surfaces of both base 300 and keycap 110.

First scissor arm 302 is may be formed as a frame that includes: base bar 316, which is substantially parallel to the surface of base 300 to which it is rotatably coupled; two parallel side bars 318 extending perpendicular to base bar 316 from its ends and coupled to second scissor arm 306 by pivots 308; and keycap bar 320, which extends between side bars 318 opposite base bar 316.

Base bar 316 is illustrated in FIGS. 3A-C as including pins at either end that extend outside of the axes of side bars 318. These pins may be used to rotatably couple first scissor arm 302 to base 300. Alternatively, first scissor arm 302 may be rotatably coupled to base 300 at an intermediate portion of base bar 316 and these pins may be omitted.

Scissor pins 304 are coupled to the first frame arm at the end of keycap bar 320 and may extend outside of the axes of side bars 318 collinear to the axis of keycap bar 320. In an example assembled key, scissor pins 304 are held in slide grooves 312 of keycap 110 and are capable of sliding within these slide grooves during operation of the key. Also during operation of the key, keycap bar 320 slides along scissor contact surface 314 of keycap 110.

FIG. 3C illustrates how clearances within an example keyswitch mechanism may lead to spaces between various mechanical components of the mechanism. For example, keycap bar 320 of first scissor arm 302 is illustrated as not being in direct contact with scissor contact surface 314 of keycap 110 and scissor pins 304 of the scissor mechanism are not in direct contact with slide groves 312 of keycap 110. These gaps have been exaggerated for illustrative purposes, but they may represent the sort of spaces that can result from clearances between components, such as first scissor arm 302 and slide groove 312 of keycap 110 (shown in FIG. 3B), which are employed to avoid binding of the scissor mechanism during operation. Such gaps between keyswitch components may lead to key rattle.

Figure 4A:
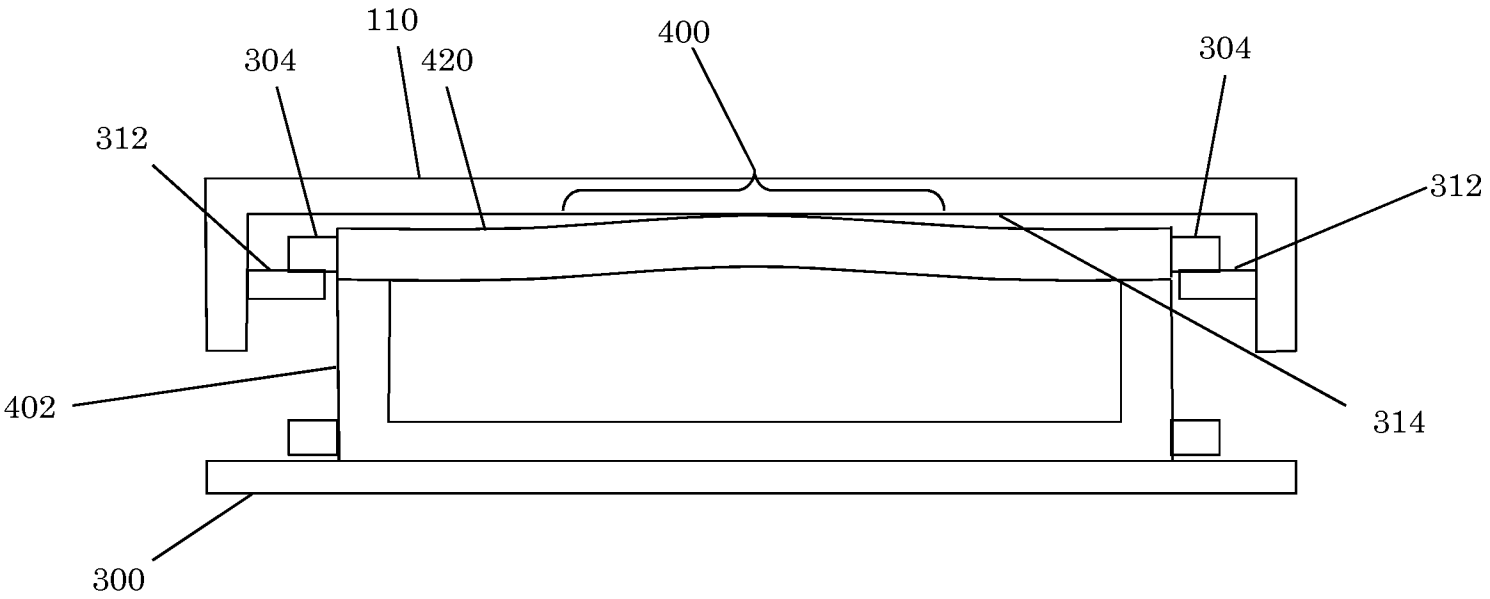
FIG. 4A front cut-away drawing of an example keyswitch mechanism according to an embodiment.

FIG. 4A illustrates one embodiment that may reduce key rattle in scissor-type keyswitch mechanisms by tightening a fit of scissor slide pins 304 of the scissor mechanism within slide grooves 312 of keycap 110.

In the example embodiment of FIGS. 3A-C, the use of clearances to avoid binding of the scissor mechanism leads to spaces between various mechanical components of the keyswitch mechanism. These spaces may also allow unintended movement of these components relative to each other, which is a potential source of key rattle. For example, as illustrated in FIG. 3A, this example keyswitch mechanism may include gaps between scissor slide pins 304 of the scissor mechanism and corresponding slide grooves 312 of keycap 310, as well as a gap between keycap bar 320 of first scissor arm 302 and scissor contact surface 314 of keycap 110.

In the example embodiment of FIG. 4A, however, keycap bar 420 of first scissor arm 402 includes a rattle suppression feature, namely arch 400. Arch 400 of keycap bar 420 extends in a direction perpendicular to the axis of keycap bar 420 (and substantially perpendicular to the axes of the side bars of first scissor arm 402) to press against scissor contact surface 314 of keycap 110. This pressure on keycap bar 420 may cause first scissor arm 402 to pivot slightly, bringing scissor slide pins 304 of the scissor mechanism into contact with the contact surfaces of slide grooves 312 of keycap 310. In this way, arch 400 in keycap bar 420 may suppress key rattle in the example keyswitch mechanism by tightening the fit of scissor slide pins 304 within slide grooves 312.

It may be noted that the use of arch 400 in keycap bar 420 as a rattle suppression mechanism in the example keyswitch mechanism of FIG. 4A may reduce (or possibly eliminate) the clearances between mechanical components in the mechanism. To avoid binding of the keyswitch mechanism during key operation, it may be useful for at least a portion of keycap bar 420 to be elastically deformable along the direction that the rattle suppression feature, arch 400, extends, e.g. at least partially flattening arch 400. This elastic deformation may be due to flexibility of keycap bar 420 along its axis or to compressibility of the material in arch 400, or to both.

Such elastic deformability of keycap bar 420 may not only be useful to avoid binding of the keyswitch mechanism, but it may also be useful to allow scissor slide pins 304 of the scissor mechanism to maintain a constant contact with the contact surfaces of slide grooves 312 of keycap 310, even when a force is exerted on a portion of keycap 110 that may cause the keycap to tilt or drop. For example, in the example key switch mechanism of FIGS. 3A-C, key rattle may occur due to pressure on one side of the key, which may cause the other side to rise in such a way that scissor slide pins 304 may engage and disengage with the contact surfaces of slide grooves 312 or keycap bar 320 may click against scissor contact surface 314. Alternatively, when the key is released the contact surfaces of slide grooves 312 may rebound and clicks against scissor slide pins 304. By placing a constant bias pressure on various mechanical components of the example keyswitch mechanism in the example embodiment of FIG. 4A, the elastic deformation of keycap bar 420 may reduce key rattle from these multiple sources.

Figure 4B:
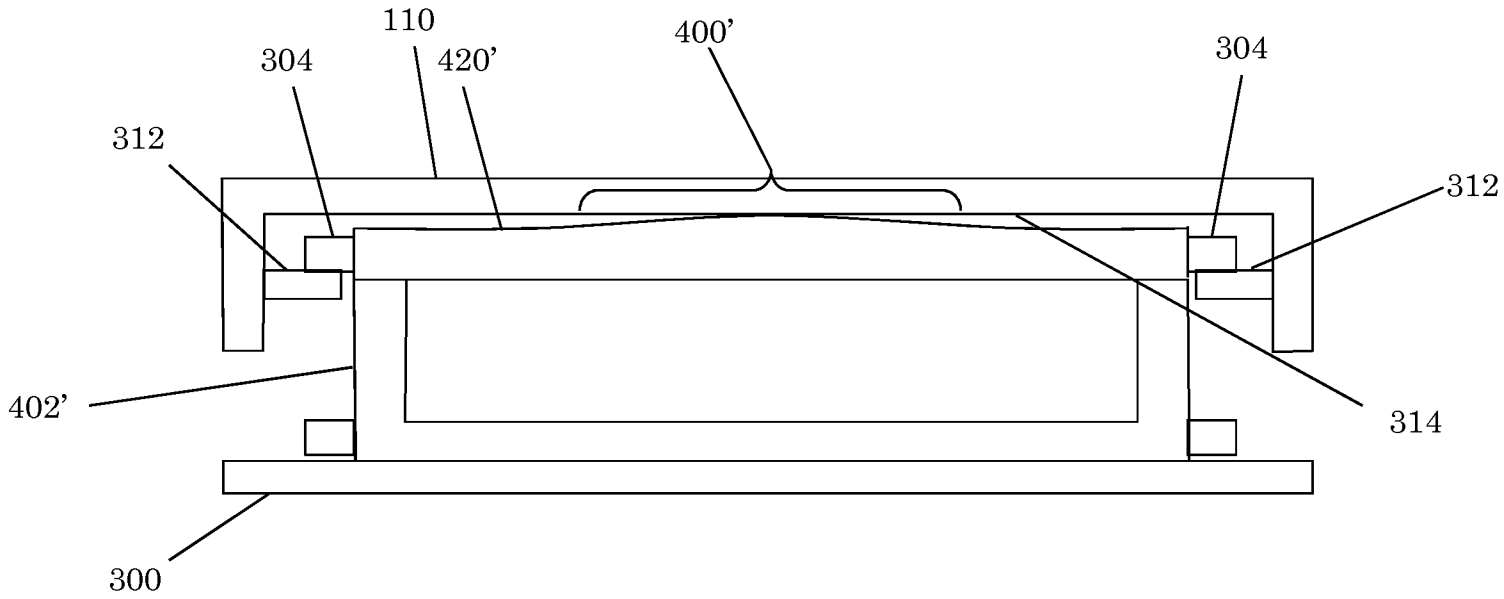
FIG. 4B is front cut-away drawing of another example keyswitch mechanism according to an embodiment.

FIG. 4B illustrates another sample embodiment. In this example embodiment keycap bar 420' includes bump 400' as a rattle suppression feature, rather than arch 400. This example embodiment functions similarly to the example embodiment of FIG. 4A, reducing key rattle by tightening the fit of scissor slide pins 304 within slide grooves 312.

Figure 4C:
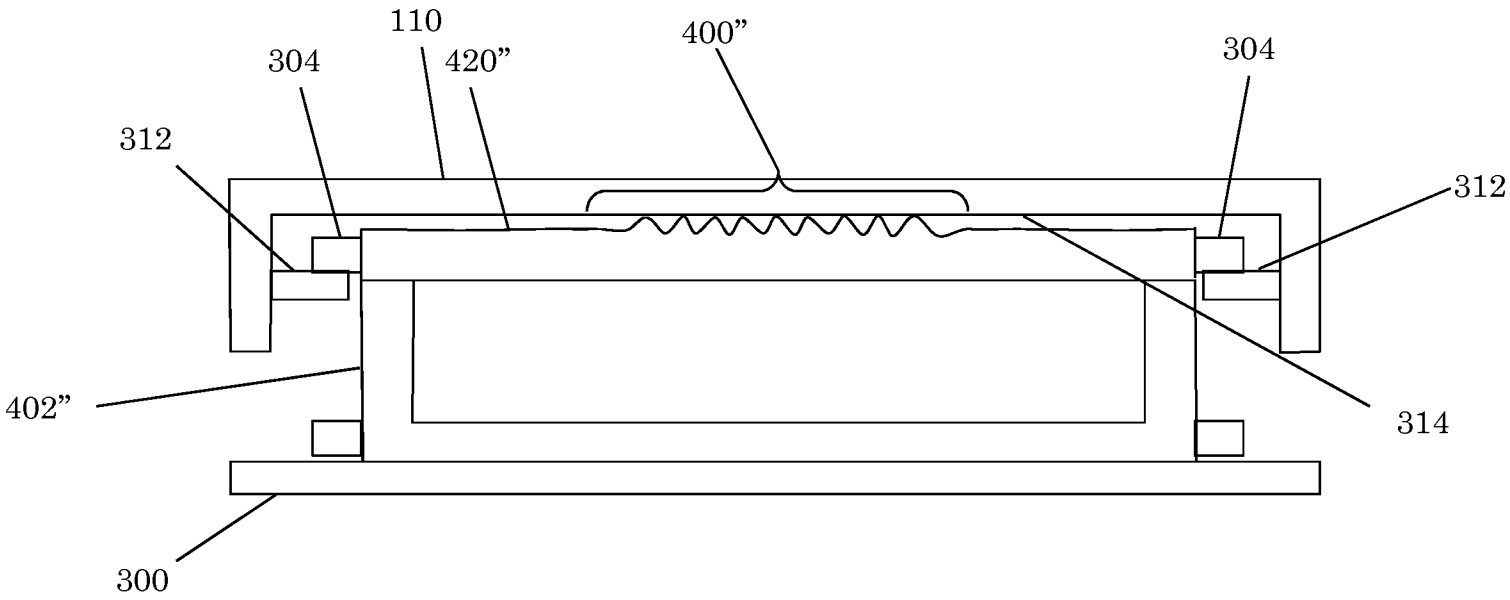
FIG. 4C is front cut-away drawing of a further example keyswitch mechanism according to an embodiment.

FIG. 4C illustrates a further sample embodiment. In this example embodiment keycap bar 420" includes a series of ridges 400" as a rattle suppression feature, rather than arch 400 or bump 400'. This example embodiment also functions similarly to the example embodiments of FIGS. 4A and 4B, reducing key rattle by tightening the fit of scissor slide pins 304 within slide grooves 312.

One skilled in the art may understand that the example embodiments of FIGS. 4B and 4C may have the same issue of possible binding as the example embodiment of FIG. 4A. Thus, it may be useful for a portion of keycap bars or associated rattle suppression features to be elastically deformable in these example embodiments as well.

Figure 5A:
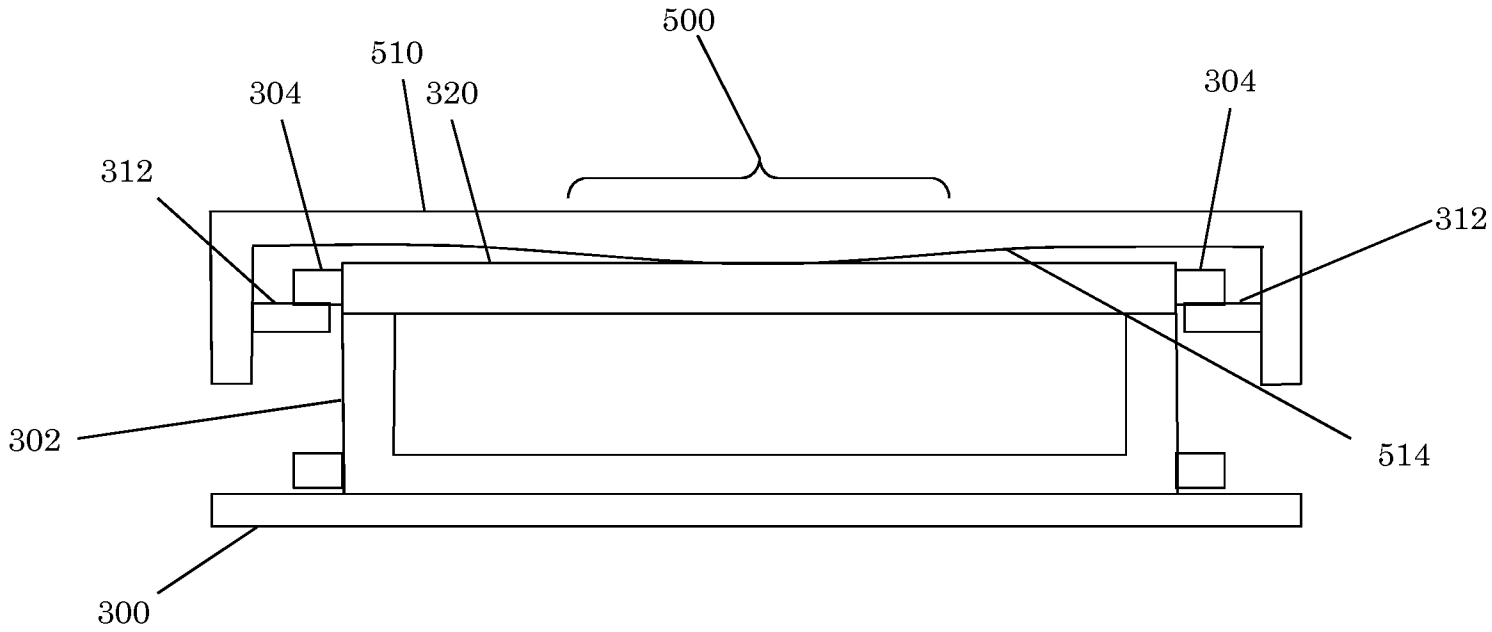
FIG. 5A is front cut-away drawing of an additional example keyswitch mechanism according to an embodiment.

FIG. 5A illustrates an additional sample keyswitch mechanism having reduced key rattle. In this example embodiment, scissor contact surface 514 of keycap 510 includes a rattle suppression feature, bump 500. Bump 500 functions similarly to the example rattle suppression features of FIG. 4A-C (arch 400, bump 400', and ridges 400"), tightening the fit of scissor slide pins 304 within slide grooves 312 of keycap 510, albeit by bump 500 on scissor contact surface 514 of keycap 510 pressing keycap bar 320 of first scissor arm 302 rather than by a rattle suppression feature on the keycap bar of the first scissor arm pressing on scissor contact surface 314 of keycap 110. Similarly to the example embodiments of FIGS. 4A-C, it may be useful for the rattle suppression feature, bump 500, to be elastically deformable to avoid issues of components binding.

Figure 5B:
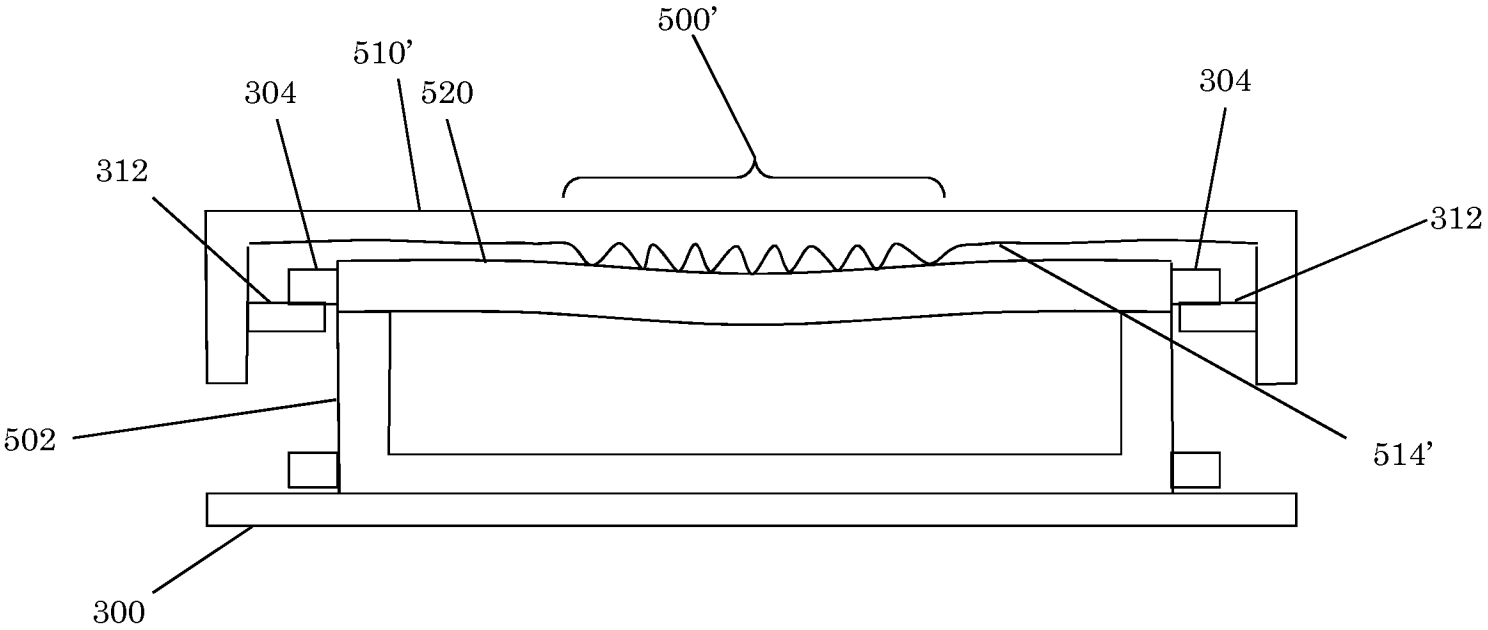
FIG. 5B is front cut-away drawing of yet another example keyswitch mechanism according to an embodiment.

FIG. 5B illustrates yet another example keyswitch mechanism having reduced key rattle. In this embodiment, scissor contact surface 514' of keycap 510' includes a rattle suppression feature, a series of ridges 500'. Ridges 500' function similarly to bump 500 of FIG. 5A, pressing on keycap bar 520 of first scissor arm 502 to tighten the fit of scissor slide pins 304 within slide grooves 312 of keycap 510.

As in the example embodiments of FIGS. 4A-C and 5A, it may be useful for the rattle suppression feature, ridges 500', to be elastically deformable to avoid or prevent components from binding. The example keyswitch mechanism of FIG. 5B includes an additional feature that may avoid issues of components binding. In this example embodiment, at least a portion of keycap bar 520 of first scissor arm 502 is elastically deformable. This elastically deformable portion of keycap bar 520 of first scissor arm 502 may be flexible or compressible. Although not shown in FIG. 5A, one skilled in the art may understand that this example feature may be used conjunction with the example embodiment of FIG. 5A.

Figure 6A:
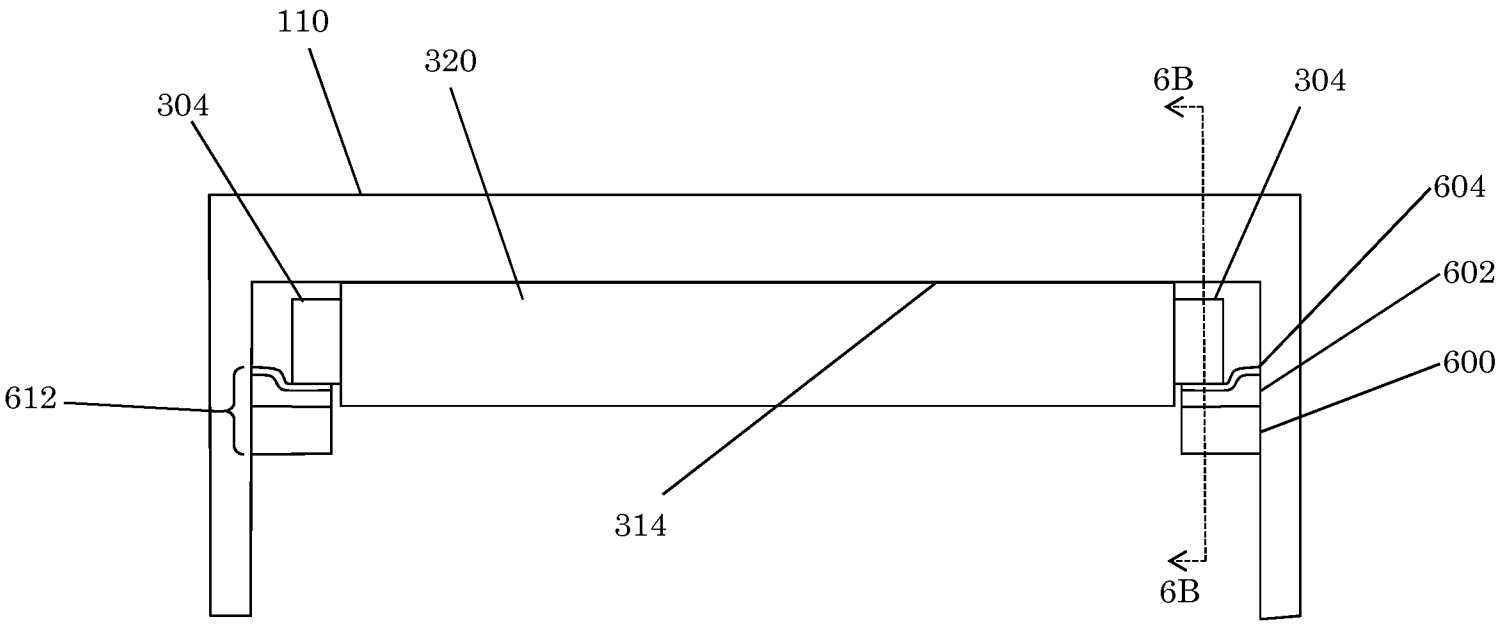
FIG. 6A is front cut-away drawing of yet a further example keyswitch mechanism according to an embodiment.
Figure 6B:
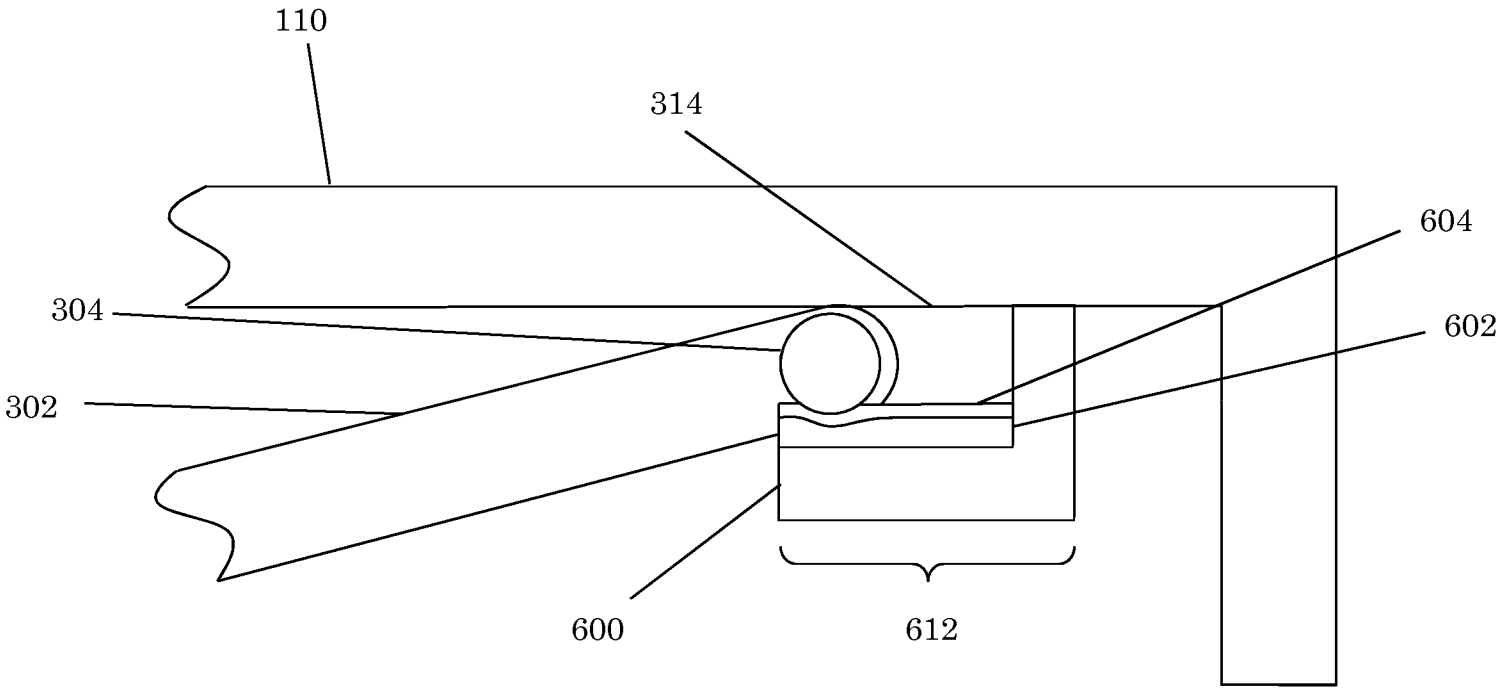
FIG. 6B is front cut-away drawing the example keyswitch mechanism FIG. 6A along line 6B-6B.

FIGS. 6A and 6B illustrate yet another example keyswitch mechanism having reduced key rattle. In this example embodiment, slide grooves 612 each have body 600 and a deformable contact surface that includes compressible layer 602 and flexible layer 604. This deformable contact surface may allow scissor contact surface 314 of keycap 110 to be held in contact with keycap bar 320 of first scissor arm 302 without binding the scissor mechanism. Scissor slide pins 304 are pressed against the respective deformable contact surfaces of the slide grooves 614 with sufficient pressure to deform the deformable contact surfaces. As in the previous described example embodiments, the tightening fitting of the scissor mechanism components generally leads to reduced key rattle.

In this example embodiment, compressible layer 602 may absorb the bulk of the pressure from scissor slide pins 304. Flexible layer 604 may serve to protect compressible layer 602. Alternatively (or additionally), flexible layer 604 may provide a lower friction layer to further avoid binding of the scissor mechanism. It is noted that, although illustrated as a two layer composite, the example deformable contact surface of slide groves 612 may be formed of a single compressible layer.

Figure 7:
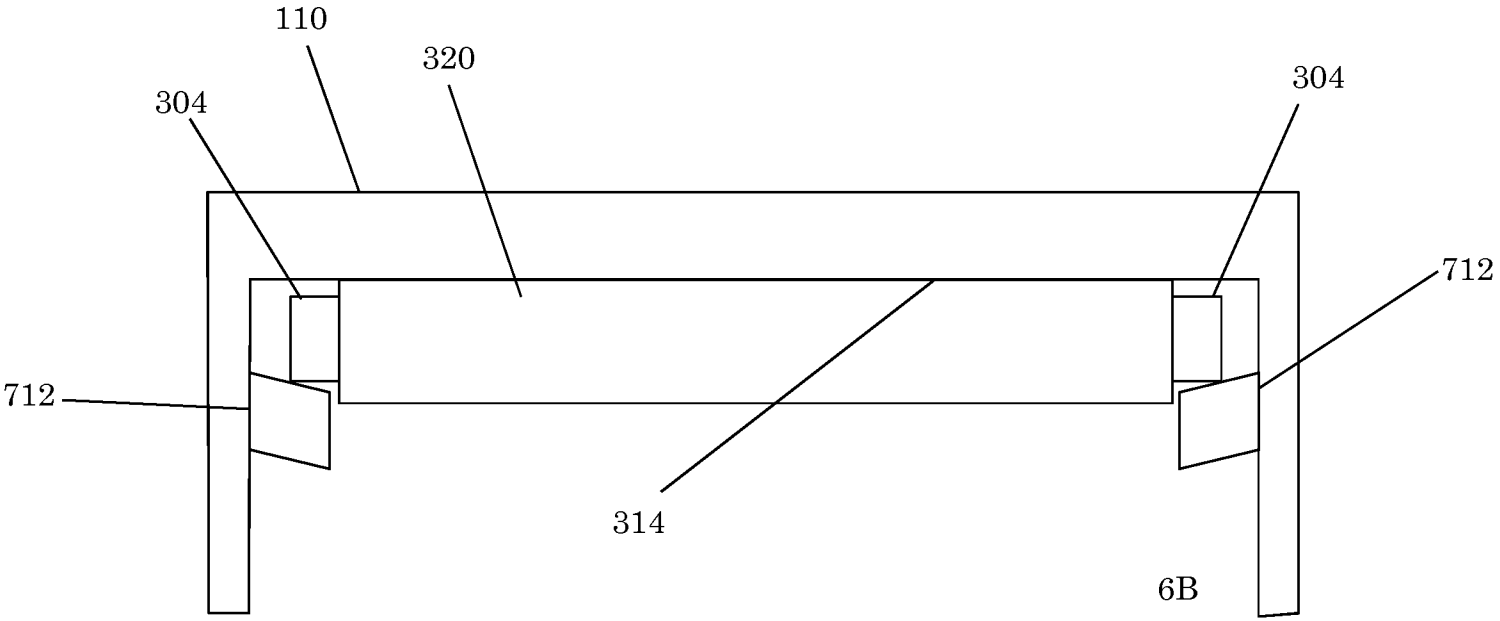
FIG. 7 is front cut-away drawing of yet an additional example keyswitch mechanism according to an embodiment.

FIG. 7 illustrates yet a further example keyswitch mechanism having reduced key rattle. In this example embodiment, slide grooves 712 are able to deform by flexing. As in the example embodiment of FIGS. 6A and 6B, this deformation of may slide grooves 712 allow scissor contact surface 314 of keycap 110 to be held in contact with keycap bar 320 of first scissor arm 302 without binding the scissor mechanism. Scissor slide pins 304 are pressed against the respective slide grooves 714 with sufficient pressure to slightly flex them. As in the previous described example embodiments, the tightening fitting of the scissor mechanism components may lead to reduced key rattle.

It is noted that tightening the fit of the scissor slide pins within the slide grooves of the keycap, as illustrated in each of the preceding example embodiments, may, in addition to reducing key rattle in the example keyswitch mechanism, also lead to increased friction between components of the keyswitch mechanism as they slide during key operation. In particular, this tightened fit may increase friction between the surface of the keycap bar and scissor contact surface and between the surface of scissor slide pins and the surface of slide grooves of the keycap. Therefore, it may be useful for one or more of these surfaces to be formed of a thermoplastic, such as nylon, high-density polyethylene (HDPE), or polytetrafluoroethylene (PTFE), to reduce the coefficient of friction between these surfaces.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context of particular embodiments. Functionality may be separated or combined in procedures differently in various embodiments of the disclosure or described with different terminology. These and other variations, modifications, additions, and improvements may fall within the scope of the disclosure as defined in the claims that follow.

We claim:

1. A keyswitch mechanism having reduced key rattle, comprising:
- a base having a surface;
- a scissor mechanism slidably coupled to the base, the scissor mechanism including a keycap bar, the keycap bar comprising:
  - a first scissor slide pin at a first end of the keycap bar;
  - a second scissor slide pin at a second end of the keycap bar; and
  - a keycap contacting portion extending between the first and second scissor slide pins and distinct from the first and second scissor slide pins;
- a keycap abutting at least the keycap contacting portion of the keycap bar; and
- a rattle suppression mechanism included on the keycap contacting portion of the keycap bar, the rattle suppression mechanism configured to maintain a biasing force between the keycap bar and the keycap.

2. The keyswitch mechanism of claim 1, wherein:
- the scissor mechanism includes:
  - a first scissor arm frame including a base portion coupled to the base and the keycap bar;
  - a second scissor arm; and
  - pivots to rotatably attach the second scissor arm to the first scissor arm frame;
- the keycap includes a first slide groove, a second slide groove, and a scissor contact surface extending between the first and second slide grooves, the first and second slide grooves being sized and located to slidably hold the first and second scissor slide pins of the scissor mechanism, respectively; and
- the rattle suppression mechanism includes at least one rattle suppression feature formed on the keycap portion of the first scissor arm frame.

3. The keyswitch mechanism of claim 2, wherein:
- the first scissor arm frame of the scissor mechanism includes:
  - a base bar forming the base portion, the base bar having a first base bar end, a second base bar end and a base bar axis extending between the first base bar end and the second base bar end, the first scissor arm frame aligned such that the base bar axis is substantially parallel to the surface of the base;and
  - two side bars having side bar axes substantially perpendicular to the base bar axis, one side bar extending from the first base bar end and the other side bar extending from the second base bar end; and
- the first and second slide grooves of the keycap are further sized and located to slidably hold the first and second scissor slide pins of the scissor mechanism, respectively, such that the at least one rattle suppression feature formed on the keycap bar of the scissor mechanism is further configured to press against the scissor contact surface of the keycap, thereby tightening a fit of the first and second scissor slide pins within the first and second slide grooves.

4. The keyswitch mechanism of claim 3, wherein at least a portion of the keycap bar of the scissor mechanism is elastically deformable.

5. The keyswitch mechanism of claim 4, wherein the deformable portion of the keycap bar of the scissor mechanism is at least one of:
- flexible; or
- compressible.

6. The keyswitch mechanism of claim 3, wherein the at least one rattle suppression feature of the keycap bar of the scissor mechanism includes at least one of:
- an arch in the keycap bar;
- a bump on the keycap bar; or
- at least one ridge on the keycap bar.

7. The keyswitch mechanism of claim 2, wherein at least one of:
- a first contact surface of the first slide groove of the keycap and a second contact surface of the second slide groove of the keycap are formed of a thermoplastic material;
- a first pin surface of the first scissor slide pin of the scissor mechanism and a second pin surface of the second scissor slide pin of the scissor mechanism are formed of a thermoplastic material;
- the scissor contact surface of the keycap is formed of a thermoplastic material; or
- a feature surface of the at least one rattle suppression feature formed on the keycap contacting portion of the keycap bar is formed of a thermoplastic material.

8. The keyswitch mechanism of claim 1, wherein the rattle suppression mechanism is at least one of:
- flexible; or
- compressible.

9. A keyswitch mechanism having reduced key rattle, comprising:
- a base having a surface;
- a scissor mechanism slidably coupled to the base; and
- a keycap abutting the scissor mechanism, the keycap comprising:
  - a first slide groove disposed on an underside of the keycap and configured to receive a first scissor slide pin of the scissor mechanism;

a second slide groove disposed on the underside of the keycap and configured to receive a second scissor slide pin of the scissor mechanism, wherein the second slide groove is set apart from the first slide groove;

a scissor contact surface disposed between the first and the second slide grooves; and a rattle suppression mechanism formed on the scissor contact surface of the keycap, the rattle suppression mechanism configured to maintain a biasing force between the keycap and a portion of the scissor mechanism abutting the keycap.

10. The keyswitch mechanism of claim 9, wherein:

the scissor mechanism includes:

a first scissor arm frame;

a second scissor arm rotatably coupled to the first scissor arm frame; and first and second scissor slide pins extending from the first scissor arm frame; and the keycap includes a first slide groove and a second slide groove, the first and second slide grooves being sized and located to slidably hold the first and second scissor slide pins of the scissor mechanism, respectively.

11. The keyswitch mechanism of claim 10, wherein:

the first scissor arm frame of the scissor mechanism includes:

a base bar coupled to the base and having a base bar axis, the first scissor arm frame aligned such that the base bar axis is substantially parallel to the surface of the base;

a keycap bar abutting the keycap and having a keycap bar axis substantially parallel to the base bar axis, the first and second scissor slide pins extending from the first scissor arm frame collinear to the keycap bar axis; and two side bars extending between the base bar and the keycap bar; and the first and second slide grooves of the keycap are further sized and located to slidably hold the first and second scissor slide pins of the scissor mechanism, respectively, such that the at least one rattle suppression feature formed on the scissor contact surface of the keycap is further configured to press against the keycap bar of the first scissor arm frame, thereby tightening a fit of the first and second scissor slide pins within the first and second slide grooves.

12. The keyswitch mechanism of claim 11, wherein at least a portion of the keycap bar of the first scissor arm frame of the scissor mechanism is elastically deformable.

13. The keyswitch mechanism of claim 12, wherein the deformable portion of the keycap bar of the first scissor arm frame of the scissor mechanism is at least one of:

flexible; or compressible.

14. The keyswitch mechanism of claim 11, wherein the at least one rattle suppression feature formed on the scissor contact surface of the keycap includes at least one of:

a bump on the scissor contact surface; or at least one ridge on the scissor contact surface.

15. The keyswitch mechanism of claim 10, wherein at least one of:

a first contact surface of the first slide groove of the keycap and a second contact surface of the second slide groove of the keycap are formed of a thermoplastic material;

a first pin surface of the first scissor slide pin of the scissor mechanism and a second pin surface of the second scissor slide pin of the scissor mechanism are formed of a thermoplastic material;

the scissor contact surface of the keycap is formed of a thermoplastic material; or a feature surface of the at least one rattle suppression feature formed on the keycap portion of the first scissor arm frame of the scissor mechanism is formed of a thermoplastic material.

16. The keyswitch mechanism of claim 9, wherein the rattle suppression mechanism is elastically deformable.

17. The keyswitch mechanism of claim 9, wherein the scissor contact surface is a portion of an underside of the keycap.

18. A keyboard having reduced key rattle, comprising:

a backplate;

a wiring layer coupled to the backplate;

a housing coupled to the backplate and configured to hold a plurality of keys; and the plurality of keys, each key including:

a key base mechanically coupled to at least one of the backplate or the housing;

a dome switch mechanically coupled to the key base and electrically coupled to the wiring layer;

a scissor mechanism slidably coupled to the key base, the scissor mechanism including a keycap bar comprising:

a first scissor slide pin at a first end of the keycap bar;

a second scissor slide pin at a second end of the keycap bar; and a keycap contacting portion extending between the first and second scissor slide pins and distinct from the first and second scissor slide pins;

a keycap mechanically coupled to the dome switch and abutting the scissor mechanism, the keycap comprising:

a first slide groove disposed on an underside of the keycap and configured to receive the first scissor slide pin;

a second slide groove disposed on the underside of the keycap and configured to receive the second scissor slide pin, wherein the second slide groove is set apart from the first slide groove;

a scissor contact surface disposed between the first and the second slide grooves; and a rattle suppression mechanism formed on at least one of the keycap contacting portion of the keycap bar or the scissor contact surface of the keycap, the rattle suppression mechanism configured to maintain a biasing force between the keycap and a portion of the scissor mechanism abutting the keycap.

19. A keyswitch mechanism having reduced key rattle, comprising:

a base having a surface;

a scissor mechanism slidably coupled to the base; and a keycap abutting the scissor mechanism, the keycap comprising:

a first slide groove disposed on an underside of the keycap and configured to receive a first scissor slide pin of the scissor mechanism;

a second slide groove disposed on the underside of the keycap and configured to receive a second scissor slide pin of the scissor mechanism, wherein the second slide groove is set apart from the first slide groove; and a rattle suppression mechanism comprising:

a first deformable contact surface formed on the first slide groove; and a second deformable contact surface formed on the second slide groove;

wherein the first and second slide grooves are configured to receive the first and second scissor slide pins, respectively, such that the first and second deformable contact surfaces are deformed, thereby providing forcing a portion of the scissor mechanism against a portion of the keycap.

20. The keyswitch mechanism of claim 19, wherein the first and second deformable contact surfaces of the first and second slide grooves are at least one of:

flexible; or compressible.

* * * * *